US010049651B1

(12) United States Patent
Matsunaga

(10) Patent No.: US 10,049,651 B1
(45) Date of Patent: Aug. 14, 2018

(54) RESONANCE SOUND CONTROL DEVICE

(71) Applicant: KAWAI MUSICAL INSTRUMENTS MANUFACTURING CO., LTD., Shizuoka (JP)

(72) Inventor: Kaoru Matsunaga, Shizuoka (JP)

(73) Assignee: KAWAI MUSICAL INSTRUMENTS MANUFACTURING CO., LTD., Shizuoka (JP)

( * ) Notice: Subject to any disclaimer, the term of this patent is extended or adjusted under 35 U.S.C. 154(b) by 0 days.

(21) Appl. No.: 15/949,592

(22) Filed: Apr. 10, 2018

(30) Foreign Application Priority Data

Apr. 25, 2017 (JP) ..... 2017-086580

(51) Int. Cl.

| | |
|---|---|
| ***G10H 7/00*** | (2006.01) |
| ***G10H 1/053*** | (2006.01) |
| ***G10H 1/00*** | (2006.01) |
| ***G10H 1/34*** | (2006.01) |

(52) U.S. Cl.
CPC ..... *G10H 1/053* (2013.01); *G10H 1/0008* (2013.01); *G10H 1/344* (2013.01); *G10H 2210/195* (2013.01); *G10H 2210/305* (2013.01); *G10H 2220/221* (2013.01)

(58) Field of Classification Search
CPC ..... G10H 1/053; G10H 1/0008; G10H 1/344; G10H 2210/195; G10H 2210/305; G10H 2220/221; G10H 2210/265; G10H 7/00
USPC ..... 84/626
See application file for complete search history.

(56) References Cited

U.S. PATENT DOCUMENTS 5,455,380 A * 10/1995 Matsuda ..... G10H 1/0091 84/662
6,990,435 B2 * 1/2006 Kaneko ..... G01L 1/205 340/665
9,697,816 B2 * 7/2017 Osuga ..... G10H 1/344
2009/0183624 A1 * 7/2009 Kira ..... G10H 1/24 84/622
2009/0235803 A1 * 9/2009 Iwamoto ..... G10H 1/346 84/229
2012/0247309 A1 * 10/2012 Matsuda ..... G10H 1/0091 84/735
2015/0221296 A1 * 8/2015 Nakata ..... G10H 1/06 84/725
2015/0228261 A1 * 8/2015 Nakata ..... G10H 1/06 84/622
2015/0262559 A1 * 9/2015 Beck ..... G10H 1/0016 84/645

(Continued)

FOREIGN PATENT DOCUMENTS

JP H06-83334 A 3/1994

*Primary Examiner* — David Warren
(74) *Attorney, Agent, or Firm* — Westman, Champlin & Koehler, P.A.

(57) ABSTRACT

In an electronic piano including plural keys and a sound source device (sound emission section) that emits a sound by pressing of the key, an intermediary resonance state of a resonance sound can be reproduced by including a resonance circuit that inputs a sound source from the sound source device corresponding to the each key and outputs a resonance sound, a position detection sensor (multi-stage switch section) in which plural switches close sequentially according to a key pressing state of the key, and a resonance sound control device that controls the resonance sound by an open/close state of plural switches by the position detection sensor.

9 Claims, 12 Drawing Sheets

(56) References Cited

U.S. PATENT DOCUMENTS

2016/0225360 A1* 8/2016 Osuga ..... G10H 1/344
2016/0284329 A1* 9/2016 Itoh ..... G10H 1/06

* cited by examiner

Fig.12

| SW1 | SW2 | SW3 | sosteFlag | KeyResDepth |
|---|---|---|---|---|
| OFF | OFF | OFF | OFF | 0 |
| ON | OFF | OFF | OFF | 3 |
| OFF | ON | OFF | OFF | 7 |
| ON | ON | OFF | OFF | 7 |
| OFF | OFF | ON | OFF | 7 |
| ON | OFF | ON | OFF | 7 |
| OFF | ON | ON | OFF | 7 |
| ON | ON | ON | OFF | 7 |
| OFF | OFF | OFF | ON | 7 |
| ON | OFF | OFF | ON | 7 |
| OFF | ON | OFF | ON | 7 |
| ON | ON | OFF | ON | 7 |
| OFF | OFF | ON | ON | 7 |
| ON | OFF | ON | ON | 7 |
| OFF | ON | ON | ON | 7 |
| ON | ON | ON | ON | 7 |

Fig.13

| ResDepth | KeyNo | | | | | | |
|---|---|---|---|---|---|---|---|
| | ~23 | 24~35 | 36~47 | 48~59 | 60~71 | 72~83 | 84~ |
| 0 | B0_RC0 | B1_RC0 | B2_RC0 | B3_RC0 | B4_RC0 | B5_RC0 | B6_RC0 |
| 1 | B0_RC1 | B1_RC1 | B2_RC1 | B3_RC1 | B4_RC1 | B5_RC1 | B6_RC1 |
| 2 | B0_RC2 | B1_RC2 | B2_RC2 | B3_RC2 | B4_RC2 | B5_RC2 | B6_RC2 |
| 3 | B0_RC3 | B1_RC3 | B2_RC3 | B3_RC3 | B4_RC3 | B5_RC3 | B6_RC3 |
| 4 | B0_RC4 | B1_RC4 | B2_RC4 | B3_RC4 | B4_RC4 | B5_RC4 | B6_RC4 |
| 5 | B0_RC5 | B1_RC5 | B2_RC5 | B3_RC5 | B4_RC5 | B5_RC5 | B6_RC5 |
| 6 | B0_RC6 | B1_RC6 | B2_RC6 | B3_RC6 | B4_RC6 | B5_RC6 | B6_RC6 |
| 7 | B0_RC7 | B1_RC7 | B2_RC7 | B3_RC7 | B4_RC7 | B5_RC7 | B6_RC7 |

RESONANCE SOUND CONTROL DEVICE

TECHNICAL FIELD

The present invention relates to an effect provision device in an electronic piano, and relates specifically to a resonance sound control device capable of reproducing resonance of strings (string resonance) by an electronic piano, the resonance of strings being generated in a state where the damper gets away by pressing of a key in an acoustic piano.

BACKGROUND ART

In the case of an acoustic piano, when a key of a keyboard is pressed, the damper felt gets away from the string according to rotation of a damper lever, an action comes into operation responding pressing of the key, a hammer strikes a string, vibration of the string is transferred to a sound board, and a music sound is emitted. It is configured that the damper felt is in contact with the string and suppresses vibration at the normal time (when the key is not pressed).

In the case of an electronic piano, it is conducted to improve reality of the sound by providing various additional sound and additional effects other than the actual sound of the piano which becomes main, and to make the sound similar to the emitted sound of an acoustic piano.

For example, in an acoustic piano, when plural keys are pressed simultaneously to emit the sound of a chord and the like, respective strings are struck by hammers corresponding to respective keys, the damper felts come to a state of getting away from respective strings, and therefore resonance (string resonance) occurs between plural strings.

In order to reproduce such string resonance, in an electronic piano of a related art, a process of providing an effect of resonance to a sound source at the on-position of the key that emitted a music sound was conducted.

Also, in Japanese Patent No. 2933186, there is disclosed an electronic musical instrument that controls the echo characteristic of the echo sound according to the key pressing information of each key configuring a keyboard, and it is described to conduct a process for providing an effect caused by an echo sound to a sound source.

CITATION LIST

Patent Literatures

Patent Literature 1: Japanese Patent Publication No. 2933186

SUMMARY OF INVENTION

Technical Problem

However, in the string resonance process conducted in an electronic piano of a related art, since the on-position of the key for emitting a music sound (key pressing finished state: note-on state) was made the object of the string resonance, it was not possible to reproduce a state where a key having been pressed partially as an actual acoustic piano is resonated and a resonance degree that changed according to the key pressing depth in pressing the key.

Further, although it is described in Japanese Patent No. 2933186 that, in providing an effect caused by an echo sound, the characteristics of an effect is controlled using performance information such as the after-touch, key pressing depth, and the like that become information capable of outputting for each key, it is not for a process of the string resonance.

Solution to Problems

The present invention has been proposed in view of the circumstances described above, and its object is to provide a resonance sound control device capable of reproducing an intermediary resonance state by pressing of a key in an electronic piano.

To achieve the above object, a resonance sound control device in an electronic piano including a plurality of keys and a sound emission section that emits a sound by pressing of the key according to a first aspect (Claim 1) of the present invention, comprising:

a resonance circuit that inputs a sound source from the sound emission section corresponding to the each key and outputs a resonance sound;

a multi-stage switch section in which a plurality of switches close sequentially according to a key pressing state of the key; and a resonance sound control section that controls the resonance sound by an open/close state of the plurality of switches by the multi-stage switch section.

The present invention of the Claim 2 is the resonance sound control device according to claim 1, wherein the multi-stage switch section includes N pieces of switch, an intermediary resonance state of the resonance sound is reproduced in an ON-state of the first to (M−1)-th switches where M is an integer smaller than N, a perfect resonance state of the resonance sound is reproduced in an ON-state of the M-th switch, and an actual sound of the electronic piano is emitted in an ON-state of the N-th switch.

The present invention of the Claim 3 is the resonance sound control device according to claim 1, wherein the multi-stage switch section includes 3 pieces of switch, an intermediary resonance state of the resonance sound is reproduced in an ON-state of only the first switch, a perfect resonance state of the resonance sound is reproduced in an ON-state of the second switch, and an actual sound of the electronic piano is emitted in an ON-state of the third switch.

The present invention of the Claim 4 is the resonance sound control device according to claim 2 or claim 3, wherein the electronic piano includes a damper pedal, and the resonance sound control section controls a resonance sound considering a stepped down state of the damper pedal.

The present invention of the Claim 5 is the resonance sound control device according to claim 2 or claim 3, wherein the electronic piano includes a sostenute pedal, and the resonance sound control section controls the resonance sound in the resonance circuit by a resonance coefficient selected by combination of an ON/OFF state of the plurality of switches configuring the multi-stage switch section and an ON/OFF state of the sostenute pedal considering a stepped down state of the sostenute pedal.

The present invention of the Claim 6 is the resonance sound control device according to claim 4, wherein a resonance state is compared between in an ON/OFF state by the multi-stage switch section and in a stepped down state by the damper pedal, and a resonance sound is added with either state having a stronger resonance state being made the state of each key.

Advantageous Effects of Invention

With the resonance sound control device of the first feature, by controlling the resonance sound by the open/ close state of plural switches by the multi-stage switch section, an intermediary resonance state by pressing of the key can be reproduced.

With the resonance sound control device of the second feature, it is possible to set each of the intermediary resonance state of the resonance sound, the perfect resonance state of the resonance sound, and emission of the actual sound of the electronic piano by the open/close state of N-numbers of switches that configure the multi-stage switch section.

With the resonance sound control device of the third feature, it is possible to set each of the intermediary resonance state of the resonance sound, the perfect resonance state of the resonance sound, and emission of the actual sound of the electronic piano by the open/close state of the first switch (SW1), the second switch (SW2), and the third switch (SW3) that configure the multi-stage switch section.

With the resonance sound control device of the fourth feature, in reproducing the resonance state, resonance caused by the step down state of the damper pedal can be considered.

With the resonance sound control device of the fifth feature, in reproducing the resonance state, resonance caused by the step down state of the sostenuto pedal can be considered.

With the resonance sound control device of the sixth feature, it is possible to compare string resonance and damper resonance caused by the damper pedal, and to provide the resonance sound whose resonance state is stronger.

BRIEF DESCRIPTION OF DRAWINGS

An Embodiment of the present invention will be described in detail based on the following drawings.

FIG. 12 is a table used in Step S61 of the resonance coefficient calculation process of FIG. 11.

FIG. 13 is a table used in Step S66 of the resonance coefficient calculation process of FIG. 11.

DESCRIPTION OF EMBODIMENTS

Figure 1:
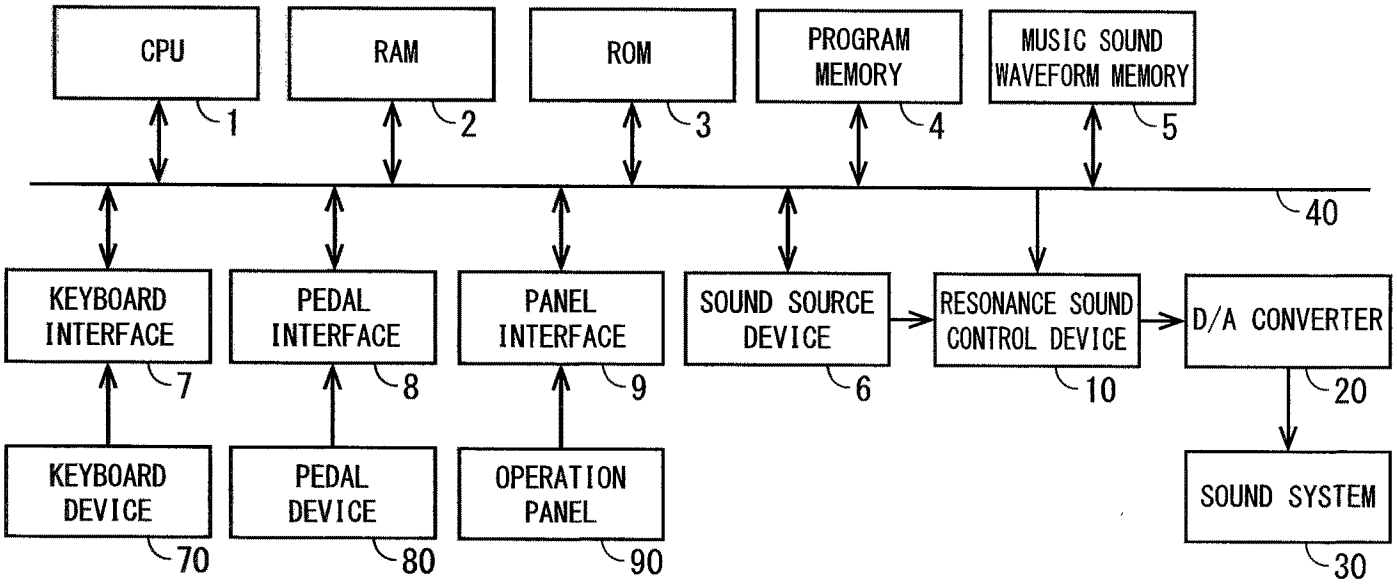

Hereinafter, a resonance sound emission device according to an embodiment of the present invention will be explained referring to the drawings. FIG. 1 is a block diagram showing a hardware configuration of an electronic piano including a resonance sound control device 10 according to an embodiment of the present invention.

In the drawing, a CPU 1, a RAM 2, a ROM 3, a program memory 4, a music sound waveform memory 5, a sound source device 6 as a sound emission section, a keyboard interface 7, a pedal interface 8, a panel interface 9, and a resonance sound control device 10 are connected to a bus line 40.

A keyboard device 70 is connected to the keyboard interface 7, a pedal device 80 is connected to the pedal interface 8, and an operation panel 90 is connected to the panel interface 9 respectively.

The keyboard device 70 includes plural (88 keys for example) keys and a position detection sensor that detects the pressing down amount of each key.

The keyboard interface 7 creates key event information and touch information based on an output signal of the position detection sensor. The information of them is linked to the key number, and is stored in the RAM 2.

The pedal device 80 is arranged in order to reproduce, by an electronic piano, an effect achieved by stepping of each pedal in an acoustic piano. The pedal device 80 includes a damper pedal that makes all strings to resonate, a sostenuto pedal that makes a specific string to resonate, a soft pedal that reduces the sound emission, and sensors (volume) that detect the stepping amount of these pedals.

The sensor (volume) that detects the stepping amount of the damper pedal is configured with a sensor that can detect 128 stages of the stepping amount, fine control is not conducted in the resonance process, and therefore it is configured to be capable of detecting the stepping amount (step down state) of 8 stages for example.

Further, the sensor (volume) that detects the stepping amount of the sostenuto pedal is also configured with a sensor that can detect 128 stages of the stepping amount, and it is configured to be capable of detecting the stepping amount (step down state) of 2 stages of ON/OFF with 64 stages for example as a boundary.

A digital/analog converter 20 is connected to the resonance sound control device 10, and a sound system 30 including amplifiers and speakers is connected to the digital/analog converter 20. With respect to the amplifier and the speaker, it is preferable to arrange at least 2 sets each so that the direction of the sound image can be controlled.

The CPU 1 controls each configuration elements according to a control program that is stored in the program memory 4. Waveform data corresponding to plural timbres are stored in the music sound waveform memory 5, and a parameter for processing the music sound waveform data and creating a music sound is stored in the ROM 3. The RAM 2 is used as a work area that temporarily stores various data when the CPU 1 executes a program. The operation panel 90 includes an LCD screen, various switches and volumes, and display lamps such as an LED, and is disposed on a control panel that is arranged adjacently to the keyboard device 70 for example.

At the time of a performance, music sound waveform data are read out from the music sound waveform memory 5 to the sound source device 6 in response to a key-on signal that is inputted from the keyboard device 70. The music sound waveform data are read out at a frequency corresponding to the key-on number included in the key-on signal. In the sound source device 6, with respect to the music sound waveform data having been read out, processes of the envelope control, addition of effects, and so on are practiced, the envelope control including formation of an attack section according to the velocity, and a music sound signal is created. The music sound signal is provided with a resonance sound by the resonance sound control device 10, is converted to an analog music sound signal by the digital/analog converter 20, and is thereafter fed to the sound system 30. In the sound system 30, the analog music sound signal is amplified by the amplifiers, and is sounded by the speakers.

Figure 2:
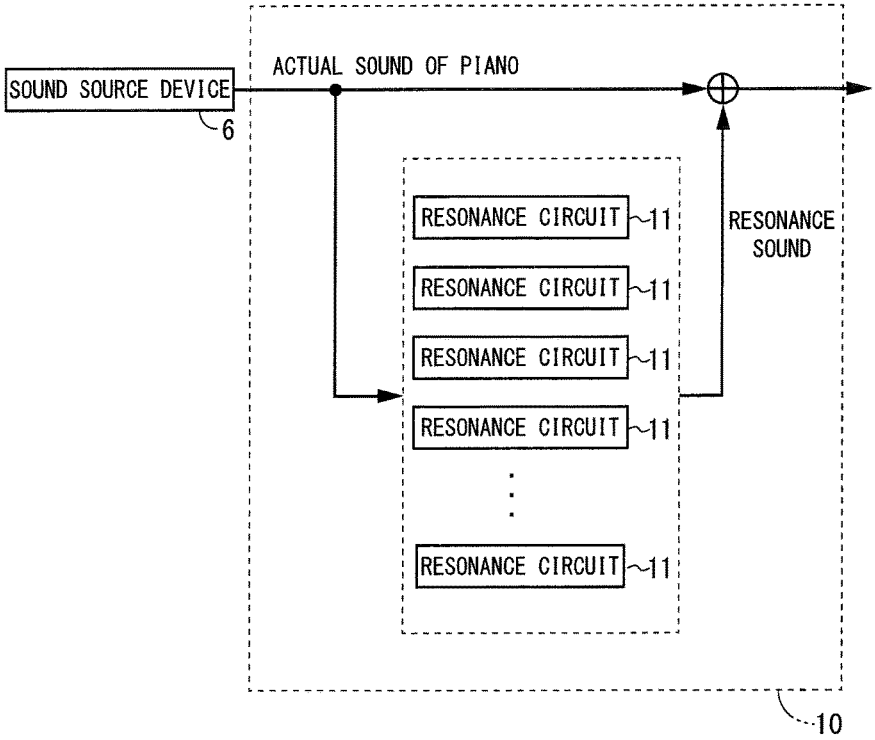
FIG. 2 is a block diagram showing a configuration of the resonance sound control device.

The resonance sound control device 10 is a device that adds the resonance sound of strings (string resonance) in a state where the damper gets away to the sound source (actual sound of a piano). As shown in FIG. 2, this resonance sound control device 10 includes each resonance circuit 11 corresponding to 88 pieces of the key respectively, and is configured so that the resonance sounds outputted from the resonance circuits 11 corresponding to the keys in a state where the damper gets away (the number of the keys pressed) are added to the sound source, and the resonance sounds are outputted.

Also, the resonance circuit 11 is configured to be capable of reproducing a state where the key partially pressed resonates in pressing the key and the resonance degree that changes according to the key pressing depth.

Figure 3:
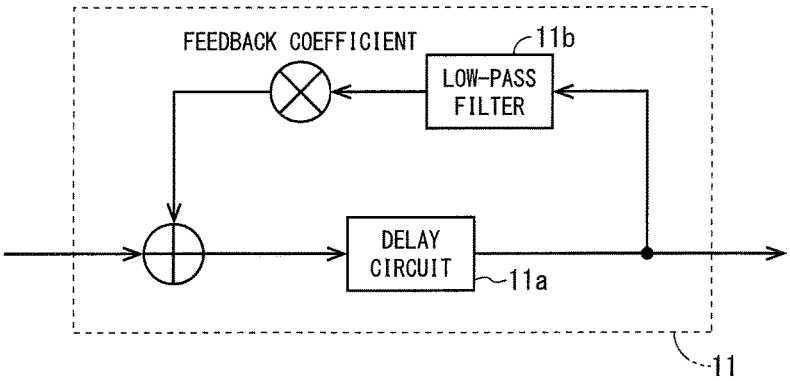
FIG. 3 is a block diagram showing the detail of a resonance circuit in the resonance sound control device.

In other words, as shown in FIG. 3, each resonance circuit 11 is configured with a circuit where an output from a delay circuit 11*a* is returned to an input side of the delay circuit 11*a* through a low-pass filter 11*b* after being multiplied by a feedback coefficient (resonance coefficient). With respect to the delay circuit 11*a*, delay time according to the tone pitch of the key is preset.

The feedback coefficient (resonance coefficient) is selected from a resonance sound coefficient table based on four elements of a key pressing state in the keyboard device 70, the stepping amount (step down state) of the damper pedal and the stepping amount (step down state) of the sostenuto pedal in the pedal device 80, and a key number in the keyboard device 70. Thereby an intermediary resonance state can be reproduced. The reason of considering the key number is that, since the string is different according to the key, the resonance coefficient is made to differ for each sound range so as to achieve a resonance sound matching the string.

The keyboard device 70 is made a three-contact keyboard where a first switch SW1, a second switch SW2, and a third switch SW3 are turned on in order in pressing the key. Thereby, the keyboard device 70 is configured to detect a pressing depth position in each key to determine the key pressing state. In other words, the actual sound is emitted when the third switch SW3 is turned on, the sound is made to be in an intermediary (low sound volume) resonance state of the key when only the first switch SW1 is turned on, the sound is determined to be in a perfect resonance state when the second switch SW2 is turned on. Thereby, an intermediary resonance state of an acoustic piano can be reproduced.

Figure 4:
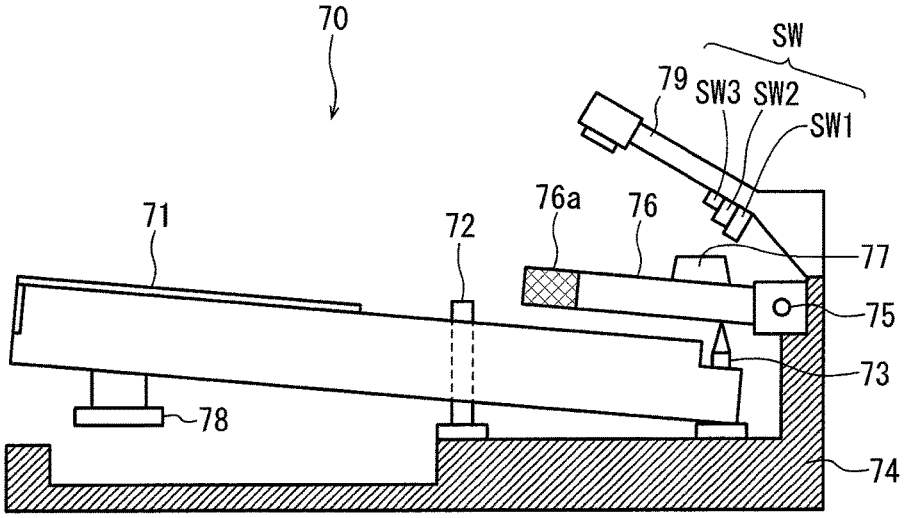
FIG. 4 is a side cross-sectional explanatory drawing showing a keyboard structure of an electronic piano.

FIG. 4 is a cross-sectional side view showing a concrete structure of the three-contact keyboard device 70 described above.

Each key 71 of the keyboard device 70 is supported by a balance pin 72 that becomes a fulcrum, and a capstan screw 73 protruding upward is arranged near the end part on a right side of the balance pin 72, namely the back direction of the key 71. In a frame 74, a hammer section 76 is arranged, the hammer section 76 extending generally in the horizontal direction and being vertically swingable around a shaft 75 that is arranged near the frame 74. Near the distal end of the hammer section 76, an action weight 76*a* is arranged.

Meanwhile, at a position of the key 71 to the left of the balance pin 72, namely near the end part in the front direction of the key 71, a counterweight 78 is arranged in a hanging state. Also, in the frame 74, a stopper 79 is arranged which suppresses the action weight 76*a* from jumping up excessively. With respect to the key 71, a side where the counterweight 78 is arranged is at a lifted position when the key 71 is not pressed.

When the key 71 is pressed at the time of a performance, a front end part of the key 71 lowers around the balance pin 72, and the back side end part of the key 71 is lifted up adversely. At this time, since the capstan screw 73 pushes up the hammer section 76 provided with the action weight 76*a*, a performer feels the reaction force of this pushing up force as a touch.

On a lower surface in a center of the stopper 79, a position detection sensor SW as a sensor for detecting a displacement amount in a vertical direction of the hammer section 76 is arranged. On an upper surface in a center of the hammer section 76, a switch pressing section 77 for pressing the position detection sensor SW is arranged. The position detection sensor SW is configured with the first to third switches SW1, SW2, SW3 having different distance to the switch pressing section 77.

The first switch SW1 detects pressing of the switch pressing section 77 arranged in the hammer section 76 that is interlocked when the key 71 starts to descend, and generates an output. The third switch SW3 detects pressing of the switch pressing section 77 at a position in the vicinity of a lowermost position of the key 71, namely at a position where the position the key 71 is pushed down to the maximum, and generates an output. The second switch SW2 detects pressing of the switch pressing section 77 in the middle of descending of the key 71, namely when the key 71 has descended to a height set between the first switch SW1 and the third switch SW3, and generates an output.

It is preferable that the position detection sensor SW is configured with a dome-shape rubber switch and a switch substrate having a junction of carbon and the like. A movable junction is arranged in the rubber switch. When the rubber switch is pressed by the switch pressing section 77, the rubber switch deforms, the movable junction comes in contact with a carbon junction, and thereby an output is generated.

Also, the position detection sensor SW may be various kinds of position detection sensors such as a magnetic sensor, an optical sensor, and a vibration sensor.

Further, as described above, the operation state (stepping amount) of the damper pedal and the sostenute pedal by the pedal device 80 comes to be related to the resonance state. In other words, with respect to the damper pedal, by stepping this pedal, the damper felt comes to a state of getting away from strings corresponding to all keys 71, and resonance (a role of extending all sounds: damper resonance) occurs among all strings. With respect to the sostenute pedal, when the key 71 is pressed and this pedal is stepped, the damper felt comes to a state of getting away from a string corresponding to the pressed key 71, this string resonates (a role of extending a specific sound), and only the sound continues even when the finger is detached from the key 71. Therefore, even by a control signal (a pedal stepping signal by the sensor) inputted from the damper pedal and the sostenute pedal of the pedal device 80, an effect corresponding to the pedal configuring the pedal device 80, namely a damper pedal effect and a sostenute pedal effect, is added to a music sound signal.

When a resonance sound is created by the resonance circuit 11 described above, it is necessary to effect control referring to not only the state of the position detection sensor SW (the first switch SW1, the second switch SW2, the third switch SW3) of the keyboard device 70 but also to the state of the damper pedal and the sostenute pedal of the pedal device 80. For example, the state by the switch of each key 71 and the state of the damper pedal are compared with each other, and the state having a stronger resonance state is made a resonance state of each key 71, and the resonance sound is added. A concrete procedure for adding a resonance sound will be described below.

Next, a music sound generation process in an electronic piano will be explained referring to the flowchart of FIG. 5.

When the electric source of the electronic piano is turned on, first, an initializing process is executed such as initializing of variables in executing each process (Step S1).

Next, a panel event process of grasping the operation state of the operation panel 90 is executed (Step S2).

Next, a key event process of grasping the key pressing state in the keyboard device 70 is executed (Step S3).

Next, a pedal event process of grasping the pedal operation state in the pedal device 80 is executed (Step S4).

Next, a resonance coefficient transfer process of transferring the resonance sound coefficient (the feedback coefficient in FIG. 3) determined from the operation state of the keyboard device 70 and the pedal device 80 is executed (Step S5).

Next, a music sound generation process of generating a music sound according to pressing of a key 71 of the keyboard device 70 is executed (Step S6).

Next, an effect provision process of providing a sound effect such as a resonance sound by the resonance sound coefficient based on Step S5 to the music sound of Step S6 is executed (Step S7).

Then, after other processes (Step S8) are executed, the process returns to Step S2.

Thereafter, the processes from Step S2 are repeated.

Figure 5:
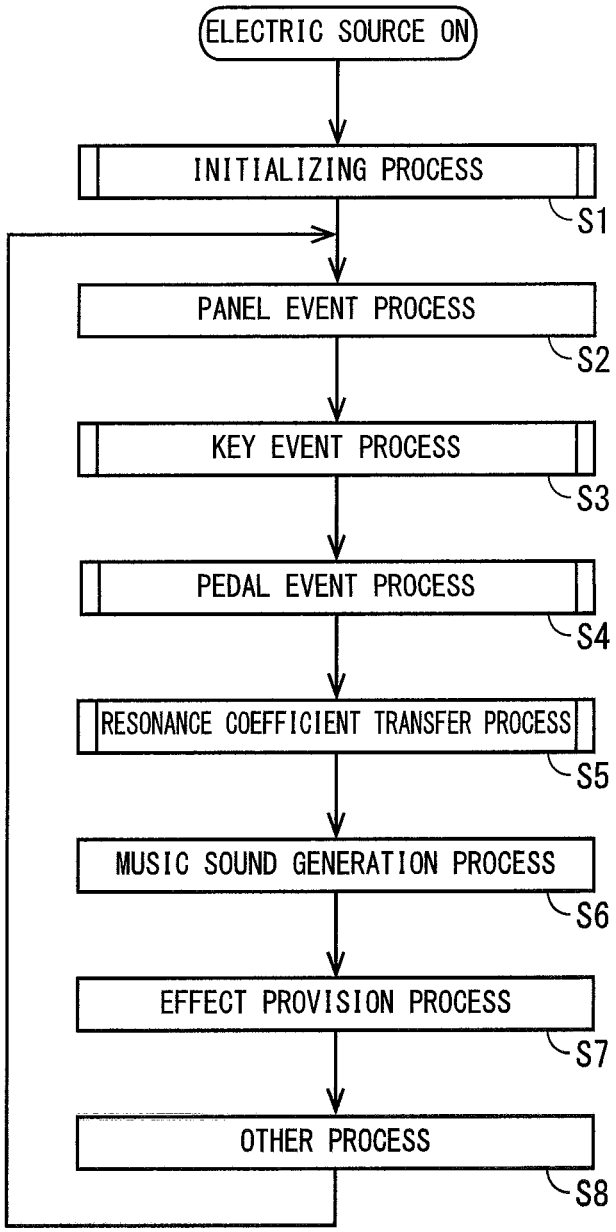
FIG. 5 is a flowchart showing processes of the entire electronic piano.
Figure 6:
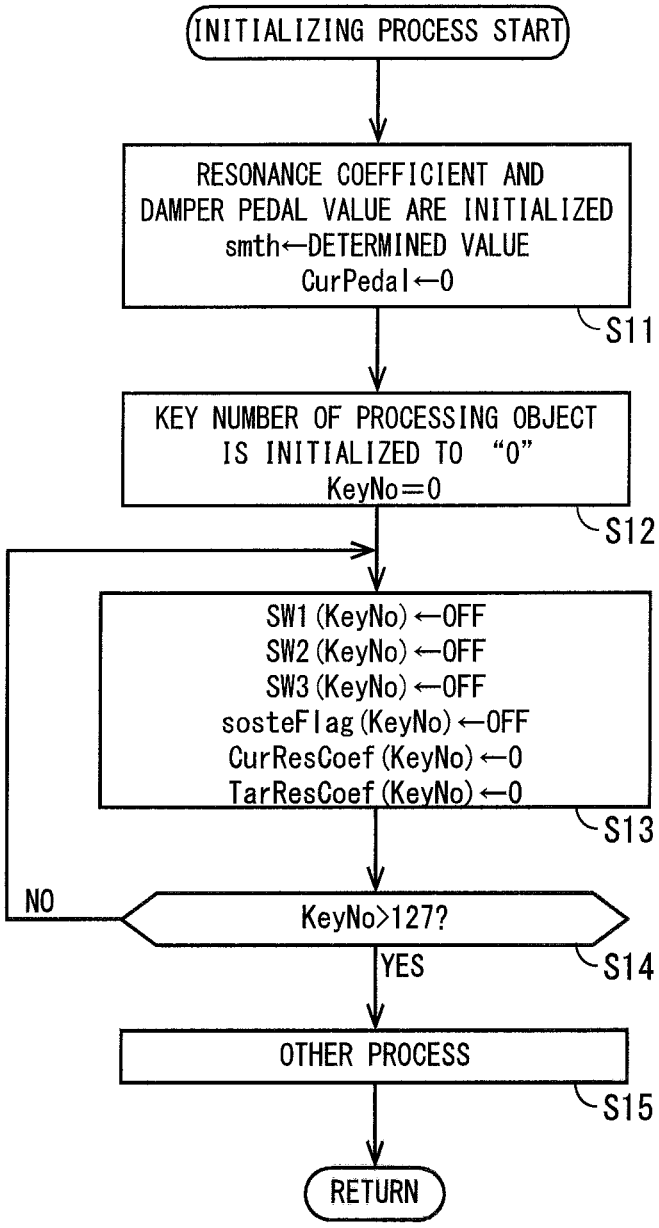
FIG. 6 is a flowchart showing the detail of the initializing process of FIG. 5.

FIG. 6 shows the detail of the initializing process of Step S1 in the flowchart of FIG. 5, and is divided into initializing processes (S11 to S13) of variables used for the resonance process, and other initializing processes (S15).

First, a smoothing coefficient (smth) of the resonance coefficient and a damper pedal value (CurPedal) are initialized (Step S11). The smoothing coefficient (smth) of the resonance coefficient is a smoothing coefficient for suppressing generation of a noise in transferring the resonance coefficient, and is set to a preset determined value for initialization. The damper pedal value (CurPedal) is a current value of the stepping amount of the damper pedal, and is initialized to "0".

Next, a key number (KeyNo) of a processing object is initialized to "0" (Step S12).

Then, SW1 (KeyNo) showing the ON/OFF state of the first switch SW1 of the key number (KeyNo), SW2 (KeyNo) showing the ON/OFF state of the second switch SW2 of the key number (KeyNo), and SW3 (KeyNo) showing the ON/OFF state of the third switch SW3 of the key number (KeyNo) are made "OFF" respectively, sosteFlag (KeyNo) showing the state of the sostenute process of the key number (KeyNo) is made "OFF", and a current value CurResCoef (KeyNo) of the resonance coefficient of the key number (KeyNo) and a target value TarResCoef (KeyNo) of the resonance coefficient of the key number (KeyNo) are made "0" (Step S13).

With respect to the process of Step S13, initialization for all keys is completed by continuing until the key number (KeyNo) becomes larger than 127 (Step S14), other initialization processes are executed (Step S15), and initialization finishes.

Although the number of pieces of the key of an electronic piano is 88 pieces, since 128 pieces of key are made the object in the process in MID employed in the standards of the electronic musical instrument, processes for 128 keys are executed in order to execute the process in compliance with the standards in the present embodiment which is the reason where the key number (KeyNo) exists up to 127.

The resonance sound control device 10 of the present invention is characterized that a resonance sound matching the resonance coefficient is added to a music sound signal of the sound source device 6 considering the key pressing state in the keyboard device 70 and the pedal operation state in the pedal device 80. Therefore, a process for adding a resonance sound to a music sound signal is executed by a series of processes of the key event process (Step S3) for grasping the key pressing state in the keyboard device 70, the pedal event process (Step S4) for grasping the pedal operation state in the pedal device 80, the resonance coefficient transfer process (Step S5) for transferring a coefficient of the resonance sound determined from the operation state of the keyboard device 70 and the pedal device 80.

Hereinafter, a procedure related to adding a resonance sound in a series of processes described above will be explained referring to the flowcharts of FIG. 7 to FIG. 11.

Figure 7:
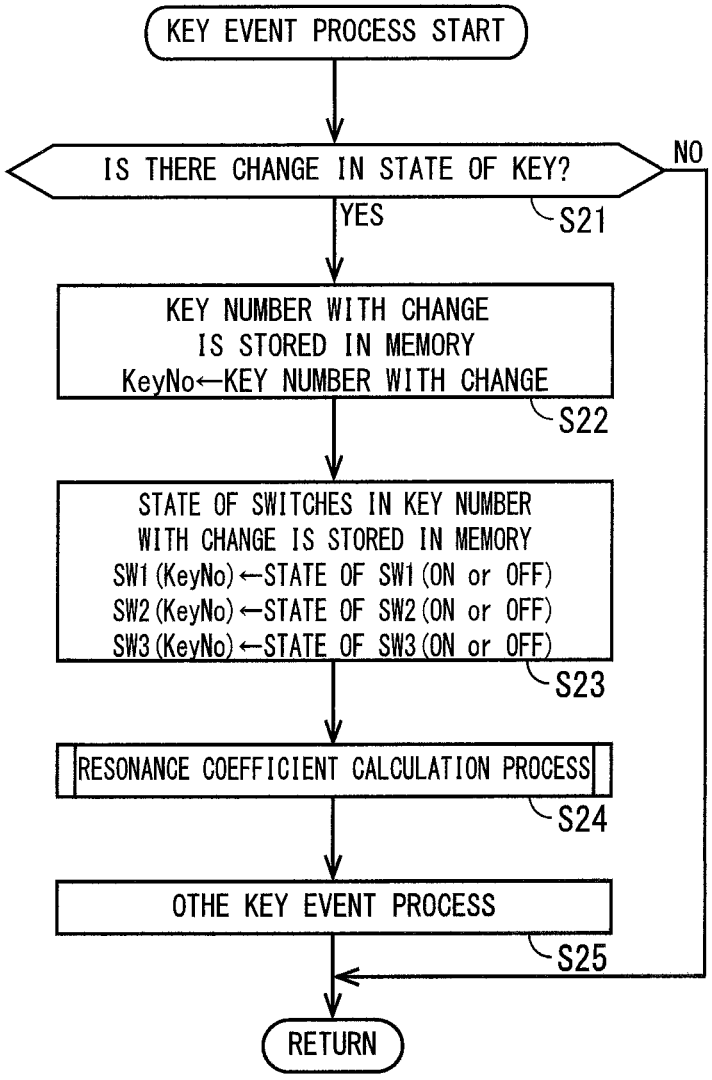
FIG. 7 is a flowchart showing the detail of the key event process of FIG. 5.

FIG. 7 shows the detail of the key event process of Step S3 in the flowchart of FIG. 5. The resonance coefficient calculation process is called up according to the state of the key having been changed, and the target value of the resonance coefficient is updated.

First, whether or not there is a change in the state of the key is determined (Step S21).

When there is a change in the state of the key in Step S21, the key number (KeyNo) with a change is stored in a memory (Step S22).

Next, the state of the first switch (SW1) to the third switch (SW3) in the key number (KeyNo) with a change is stored in the memory (Step S23). In other words, the ON/OFF state of the first switch SW1 (KeyNo), the second switch SW2 (KeyNo), and the third switch SW3 (KeyNo) is stored.

Then, from the combination of the ON/OFF state of the first switch SW1 (KeyNo), the second switch SW2 (KeyNo), and the third switch SW3 (KeyNo), a resonance coefficient calculation process for calculating the resonance coefficient is executed (Step S24). A concrete procedures of the resonance coefficient calculation process will be described below.

After the resonance coefficient calculation process is executed, the other key event process with respect to the key state other than that related to resonance coefficient calculation is executed (Step S25).

Figure 8:
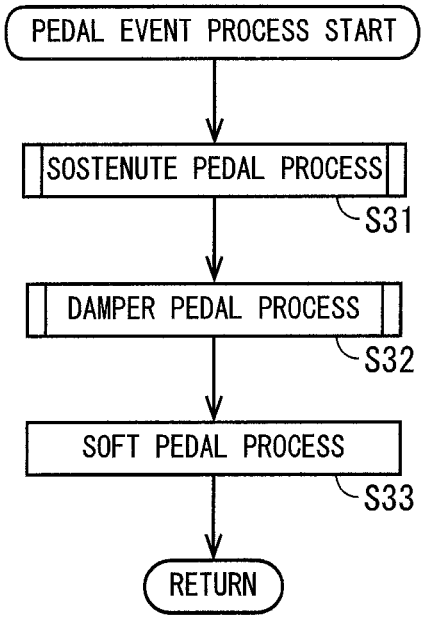
FIG. 8 is a flowchart showing the detail of the pedal event process of FIG. 5.

FIG. 8 shows a procedure of the pedal event process of Step S4 in the flowchart of FIG. 5. The pedal event process is executed in the following processes of a sostenute pedal process (Step S31) for grasping the operation state with respect to the sostenute pedal, a damper pedal process (Step S32) for grasping the operation state with respect to the damper pedal, and a soft pedal process (Step S33) for grasping the operation state with respect to the soft pedal.

Next, the sostenute pedal process (Step S31) in FIG. 8 will be explained.

Figure 9:
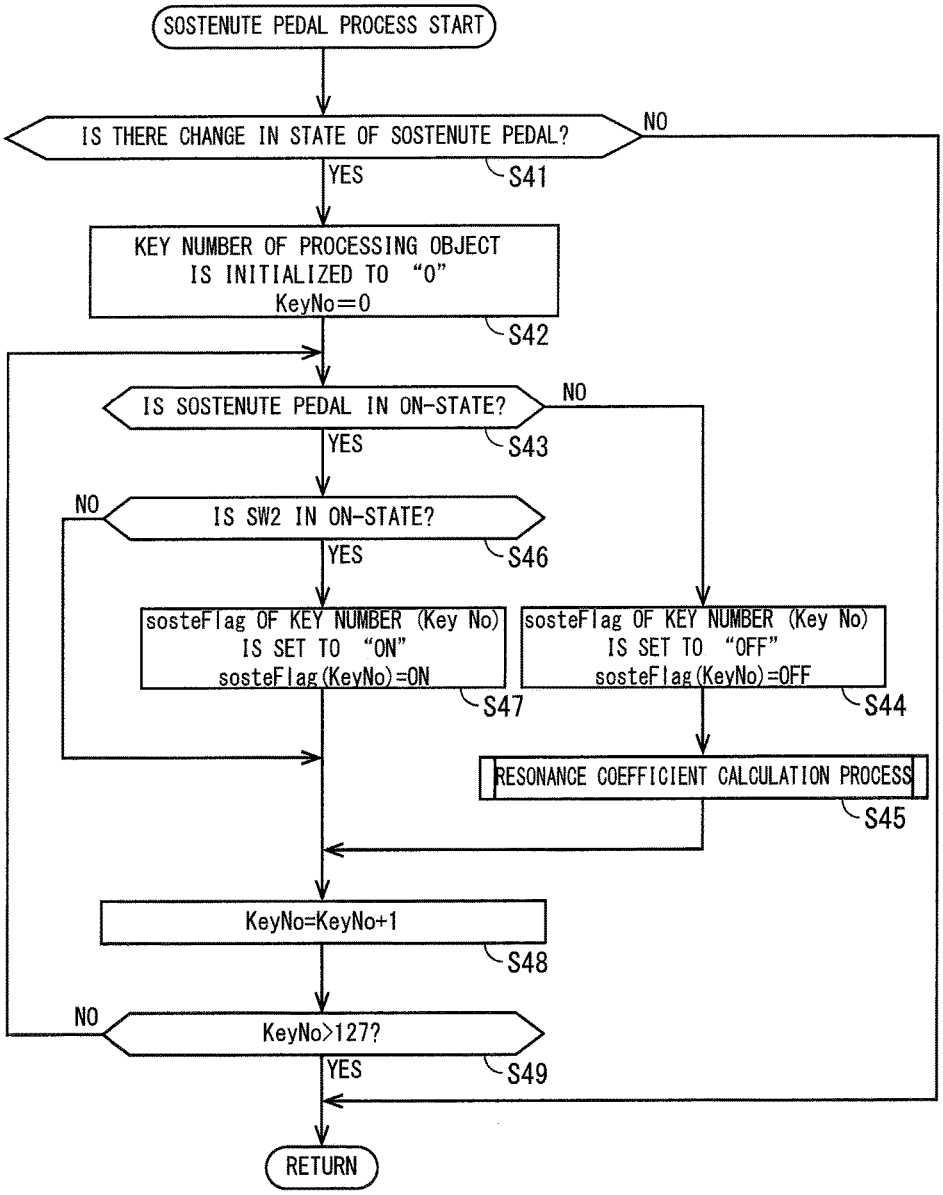
FIG. 9 is a flowchart showing the detail of the sostenuto pedal process of FIG. 8.

FIG. 9 shows the detail of the sostenuto pedal process of Step S31 in the flowchart of FIG. 8. The resonance coefficient calculation process is called up according to the state of the sostenuto pedal and the key, and the target value of the resonance coefficient is updated.

First, whether or not there is a change in the state of the sostenute pedal is determined (Step S41).

When there is a change in the state of the sostenute pedal in Step S41, the key number (KeyNo) of the processing object is initialized to "0" (Step S42).

Next, whether or not the sostenute pedal is in ON-state is determined (Step S43).

When the sostenute pedal is not in ON-state in Step S43, sosteFlag (KeyNo) of the corresponding key number (KeyNo) is set to "OFF" (Step S44), and the resonance coefficient calculation process is executed (Step S45). A concrete procedure of the resonance coefficient calculation process will be described below.

When the sostenute pedal is in ON-state in Step S43, whether or not the second switch SW2 (KeyNo) is in ON-state is determined (Step S46), sosteFlag (KeyNo) of the key number (KeyNo) corresponding to being in ON-state is set to "ON" (Step S47).

Also, when the second switch SW2 (KeyNo) is in OFF-state in Step S46, even when the sostenute pedal is in ON-state in Step S43, sosteFlag (KeyNo) of the corresponding key number (KeyNo) maintains "OFF".

KeyNo=KeyNo+1 is applied to the key number (Step S48), the processes from Step S43 to Step S49 are repeated until the key number (KeyNo) exceeds 127, and thereby the processes for all keys are executed.

Also, the reason Step 46 is executed after Step S43 is as follows.

In the case of an acoustic piano, with respect to the action of the sostenute pedal, only the damper felt of a key already pressed at the instant of stepping the sostenute pedal is maintained in a getting away state. In other words, even when the sostenute pedal is in a stepped state, a key pressed afterward does not become the object of maintaining the damper felt in a getting away state. In order to reproduce this action in an electronic piano, it is necessary to detect a key already pressed (the second switch SW2 is ON) when the sostenute pedal comes in ON-state (Step S43).

Next, the damper pedal process (Step S32) in FIG. 8 will be explained.

Figure 10:
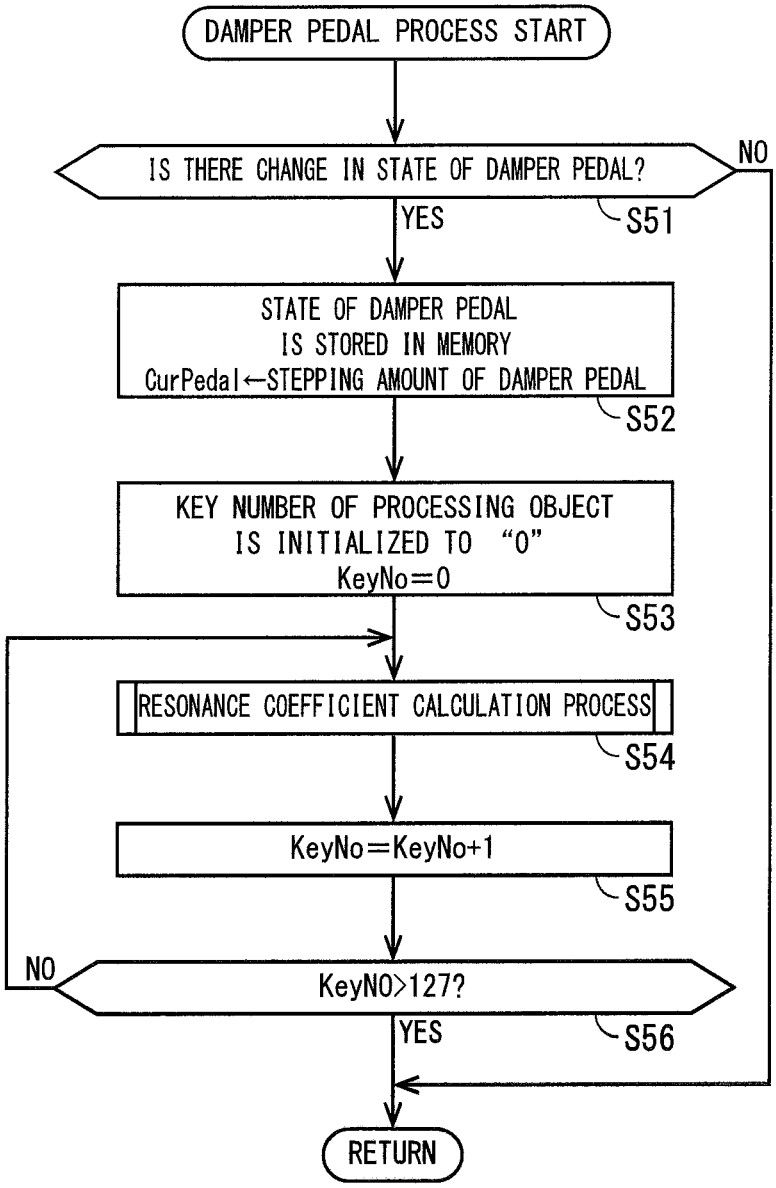
FIG. 10 is a flowchart showing the detail of the damper pedal process of FIG. 8.

FIG. 10 shows the detail of the damper pedal process of Step S32 in the flowchart of FIG. 8. The resonance coefficient calculation process is called up according to the state of the damper pedal and the key, and the target value of the resonance coefficient is updated.

First, whether or not there is a change in the state of the damper pedal is determined (Step SM).

When there is a change in the state of the damper pedal in Step S51, the state of the damper pedal is stored in a memory (Step S52).

Next, the key number (KeyNo) of the processing object is initialized to "0" (Step S53), and the resonance coefficient calculation process is executed (Step S54). A concrete procedure of the resonance coefficient calculation process will be described below.

KeyNo=KeyNo+1 is applied to the key number (Step S55), the processes from Step S54 to Step S56 are repeated until the key number (KeyNo) exceeds 127, and thereby the processes for all keys are executed.

Figure 11:
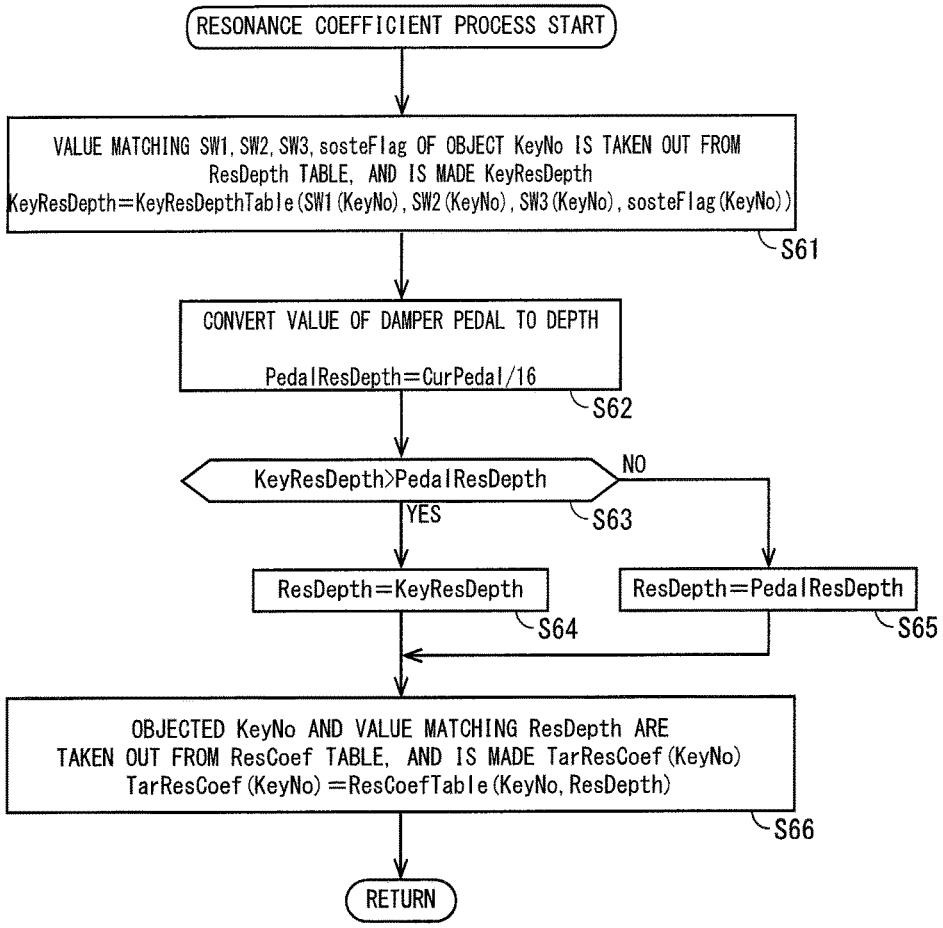
FIG. 11 is a flowchart showing the detail of the resonance coefficient calculation process in FIG. 7, FIG. 9, and FIG. 10.

Next, the resonance coefficient calculation process called up in Step S24 of FIG. 7, Step S45 of FIG. 9, and Step S54 of FIG. 10 will be explained referring to the flowchart of FIG. 11.

From the key and the state of the sostenute pedal process, KeyResDepth is determined (Step S61).

In other words, a value matching the first switch SW1, the second switch SW2, the third switch SW3 and sosteFlag of the objected key number (KeyNo) is taken out from KeyResDepth table, and is made KeyResDepth.

In this example, KeyResDepth is converted into any value of "0", "3", "7", "7", "7", "7", "7", "7" with respect to 8 kinds of combination of ON/OFF state of the first switch SW1, the second switch SW2, the third switch SW3, and sosteFlag by referring to the KeyResDepth table as shown in FIG. 12.

In other words, when sosteFlag is OFF, "0", "3", "7", and "7" become the value of KeyResDepth when the ON/OFF state of the first switch SW1/second switch SW2/third switch SW3 is OFF/OFF/OFF, ON/OFF/OFF, ON/ON/OFF, and ON/ON/ON respectively. When sosteFlag is ON, "7" becomes the value of KeyResDepth regardless of the state of the position detection switches SW (first switch SW1 to third switch SW3).

In FIG. 12, 8 kinds of key pressing information (for example sosteFlag is OFF and the first switch SW1/second switch SW2/third switch SW3 is "ON/OFF/OFF") other than 8 kinds described above is included as information for executing an error processing when an abnormality occurs. It is possible that such key pressing information is taken by mixing in of the noise and the contact failure. In such case, it is configured that the value of KeyResDepth is converted into the value ("7") shown in FIG. 12 according to the key pressing information.

Next, from the state of the stepping amount of the damper pedal, PedalResDepth is determined (Step S62). With respect to PedalResDepth, the value of the stepping amount of the damper pedal is converted into any value (0 to 7) of 8 stages by calculation.

KeyResDepth and PedalResDepth are compared with each other, and one with a deeper resonance state (one with a larger value) is employed as a resonance state ResDepth of the key (Steps S63 to S65).

ResDepth is converted into the target value TarResCoef of the resonance coefficient by taking out a value matching the key number (KeyNo) becoming the object and ResDepth from a ResCoefTable as shown in FIG. 13 and employing the same (Step S66). In FIG. 13, it is configured to refer to 7 kinds of table according to the key number (KeyNo) even for same ResDepth of "0" to "7".

For example, when ResDepth is "0", "B0_RC0" for a board of the key numbers 0 to 23, "B1_RC0" for a board of the key numbers 24 to 35, "B2_RC0" for a board of the key numbers 36 to 47, "B3_RC0" for a board of the key numbers 48 to 59, "B4_RC0" for a board of the key numbers 60 to 71, "B5_RC0" for a board of the key numbers 72 to 83, and "B6_RC0" for a board of the key numbers 84 to 127 are selected respectively as the resonance coefficient.

Although ResDepth of "0" corresponds to a state where the damper felt comes in contact with a string perfectly, with respect to a low sound string, since the mass of the string is large, even when the damper felt for stopping a sound comes in contact with the string, the sound does not stop perfectly at once. Therefore, it is set so that the selected resonance coefficient differs so as to cause a difference in the resonance sound between a low sound string and a high sound string even when ResDepth is same "0".

Figure 14:
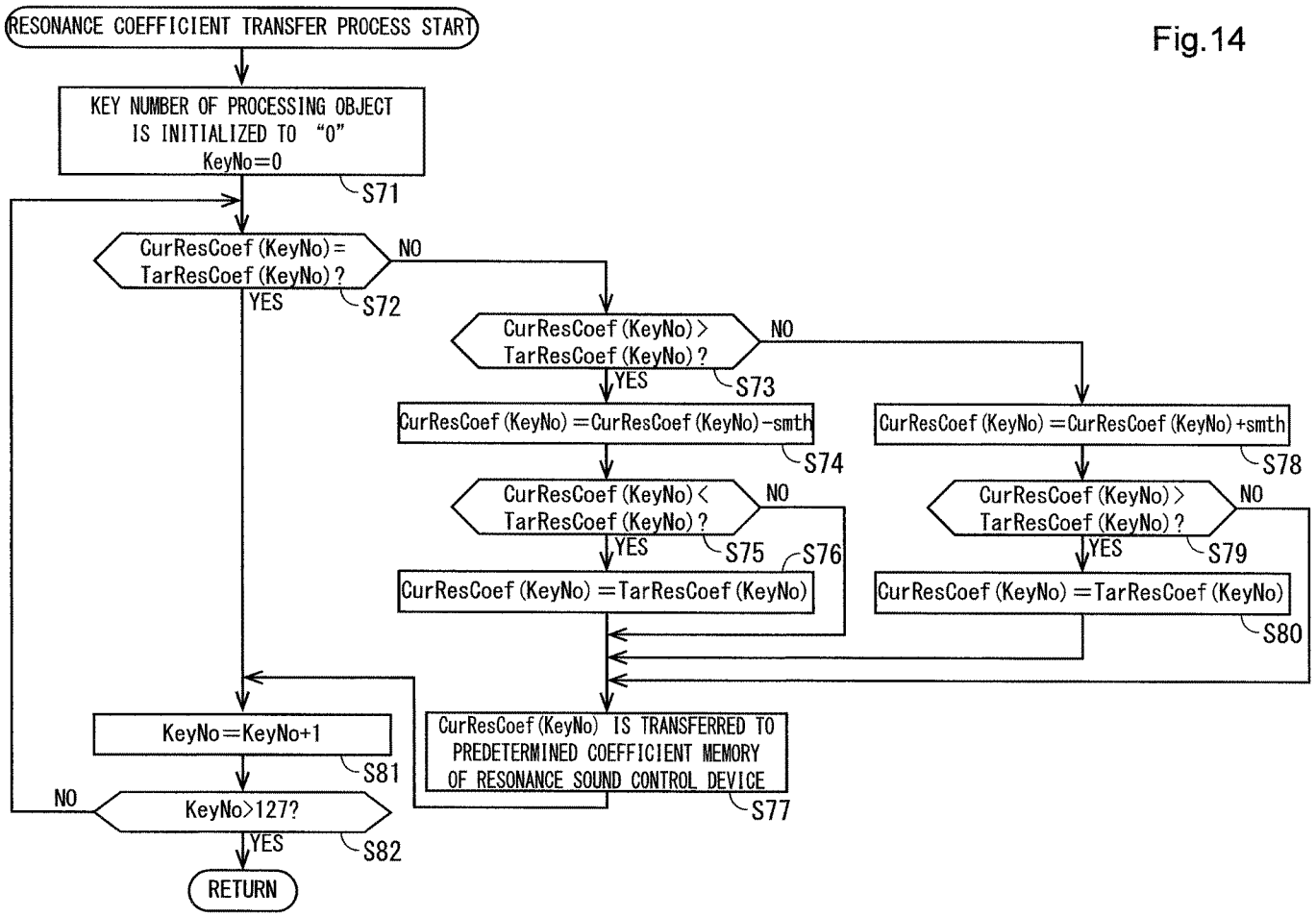
FIG. 14 is a flowchart showing the detail of the resonance coefficient transfer process of FIG. 5.

FIG. 14 shows a procedure of a resonance coefficient transfer process of Step S5 in the flowchart of FIG. 5.

The resonance coefficient is transferred for each key consecutively. The value is updated and transferred so that a noise is not generated by changing the resonance coefficient little by little (the value of smth) from the current value CurResCoef toward the target value TarResCoef.

The key number (KeyNo) of a processing object is initialized to "0" (KeyNo=0) (Step S71).

The current value CurResCoef and the target value TarResCoef are compared with each other. When the current value is equal to the target value and reaches the target value, it is determined that updating is not necessary (Step S72).

When the current value CurResCoef is not equal to the target value TarResCoef in Step S72, whether the current value CurResCoef is larger than the target value TarResCoef is determined (Step S73).

When the current value CurResCoef is larger than the target value TarResCoef in Step S73, the current value CurResCoef is updated to a value reduced slightly (the value of smth) from the current value CurResCoef (Step S74).

Whether the updated current value CurResCoef is smaller than the target value TarResCoef is determined (Step S75). When the updated current value CurResCoef is smaller, the current value CurResCoef is updated to the target value TarResCoef (Step S76). When the updated current value CurResCoef is larger, the current value CurResCoef remaining unchanged is transferred to a predetermined coefficient memory of the resonance sound control device 10 (Step S77).

When the current value CurResCoef is smaller than the target value TarResCoef in Step S73, the current value CurResCoef is updated to a value increased slightly (the value of smth) from the current value CurResCoef (Step S78).

Whether the updated current value CurResCoef is larger than the target value TarResCoef is determined (Step S79). When the updated current value CurResCoef is larger, the current value CurResCoef is updated to the target value TarResCoef (Step S780). When the updated current value CurResCoef is smaller, the current value CurResCoef remaining unchanged is transferred to the predetermined coefficient memory of the resonance sound control device 10 (Step S77).

In order to execute these processes in the next key number (KeyNo+1), (KeyNo=KeyNo+1) is applied to the key number (Step S81), and the resonance coefficient is transferred in all keys until the key number (KeyNo) reaches 127 (Step S82).

According to the resonance sound control device 10 described above, with respect to pressing of a key by the key 71, a resonance state at an intermediary key position can be reproduced by using the position detection sensor SW including the switches of 3 stages of the first switch SW1, the second switch SW2, and the third switch SW3 and utilizing a resonance coefficient matching the detected position of each key in the resonance circuit 11 as a feedback coefficient.

Also, the sound of an electronic piano can be made similar to a resonance sound of an acoustic piano by controlling a resonance sound referring to not only the state of the position detection sensor SW (first switch SW1 to third switch SW3) but also to the step down state of the damper pedal and the sostenute pedal of the pedal device 80.

11 . . . resonance circuit,
20 . . . digital/analog converter,
30 . . . sound system,
40 . . . bus line,
70 . . . keyboard device,
71 . . . key,
77 . . . switch pressing section,
80 . . . pedal device,
90 . . . operation pane,
SW . . . position detection sensor (multi-stage switch section),
SW1 . . . first switch,
SW2 . . . second switch,
SW3 . . . third switch

What is claimed is:

1. A resonance sound control device in an electronic piano including a plurality of keys and a sound emission section that emits a sound by pressing of the key, comprising:

a resonance circuit that inputs a sound source from the sound emission section corresponding to the each key and outputs a resonance sound;

a multi-stage switch section in which a plurality of switches close sequentially according to a key pressing state of the key; and a resonance sound control section that controls the resonance sound by an open/close state of the plurality of switches by the multi-stage switch section.

2. The resonance sound control device according to claim 1, wherein the multi-stage switch section includes N pieces of switch, an intermediary resonance state of the resonance sound is reproduced in an ON-state of the first to (M−1)-th switches where M is an integer smaller than N, a perfect resonance state of the resonance sound is reproduced in an ON-state of the M-th switch, and an actual sound of the electronic piano is emitted in an ON-state of the N-th switch.

3. The resonance sound control device according to claim 1, wherein the multi-stage switch section includes 3 pieces of switch, an intermediary resonance state of the resonance sound is reproduced in an ON-state of only the first switch, a perfect resonance state of the resonance sound is reproduced in an ON-state of the second switch, and an actual sound of the electronic piano is emitted in an ON-state of the third switch.

4. The resonance sound control device according to claim 2, wherein the electronic piano includes a damper pedal, and the resonance sound control section controls a resonance sound considering a stepped down state of the damper pedal.

5. The resonance sound control device according to claim 3, wherein the electronic piano includes a damper pedal, and the resonance sound control section controls a resonance sound considering a stepped down state of the damper pedal.

6. The resonance sound control device according to claim 2, wherein the electronic piano includes a sostenute pedal, and the resonance sound control section controls the resonance sound in the resonance circuit by a resonance coefficient selected by combination of an ON/OFF state of the plurality of switches configuring the multi-stage switch section and an ON/OFF state of the sostenute pedal considering a stepped down state of the sostenute pedal.

7. The resonance sound control device according to claim 3, wherein the electronic piano includes a sostenute pedal, and the resonance sound control section controls the resonance sound in the resonance circuit by a resonance coefficient selected by combination of an ON/OFF state of the plurality of switches configuring the multi-stage switch section and an ON/OFF state of the sostenute pedal considering a stepped down state of the sostenute pedal.

8. The resonance sound control device according to claim 4, a resonance state is compared between in an ON/OFF state by the multi-stage switch section and in a stepped down state by the damper pedal, and a resonance sound is added with either state having a stronger resonance state being made the state of each key.

9. The resonance sound control device according to claim 5, a resonance state is compared between in an ON/OFF state by the multi-stage switch section and in a stepped down state by the damper pedal, and a resonance sound is added with either state having a stronger resonance state being made the state of each key.

* * * * *